US005890826A

United States Patent [19]

Kim

[11] Patent Number: 5,890,826

[45] Date of Patent: Apr. 6, 1999

[54] AUTOMATIC LIPSTICK CASE

[76] Inventor: Kyoung Sook Kim, 112-904 Lucky-Apartment, Hogye2-Dong, Dongan-Ku, Anyang-City, Kyunggi-Do 430-082, Rep. of Korea

[21] Appl. No.: 875,644

[22] PCT Filed: Dec. 4, 1996

[86] PCT No.: PCT/KR96/00231

§ 371 Date: Jul. 30, 1997

§ 102(e) Date: Jul. 30, 1997

[87] PCT Pub. No.: WO97/20482

PCT Pub. Date: Jun. 12, 1997

[30] Foreign Application Priority Data

Dec. 5, 1995 [KR] Rep. of Korea ..... 1995-46778

[51] Int. Cl.[6] ..... A45D 40/06; A45D 40/22

[52] U.S. Cl. ..... 401/60; 401/59

[58] Field of Search ..... 401/59, 60

[56] References Cited

U.S. PATENT DOCUMENTS

| | | | |
|---|---|---|---|
| 2,644,577 | 7/1953 | Orenick | 401/59 |
| 5,423,622 | 6/1995 | Perrotti | 401/60 X |

FOREIGN PATENT DOCUMENTS

| | | | |
|---|---|---|---|
| 936151 | 7/1948 | France | 401/59 |
| 948199 | 7/1949 | France | 401/59 |
| 265348 | 11/1949 | Switzerland | 401/59 |
| 595666 | 12/1947 | United Kingdom | 401/59 |
| 2240768 | 8/1991 | United Kingdom | 401/59 |

*Primary Examiner*—Steven A. Bratlie

*Attorney, Agent, or Firm*—Skjerven, Morrill, MacPherson, Franklin & Friel LLP; Alan H. MacPherson

[57] ABSTRACT

The lipstick case has a lipstick dish or cup which has a protrusion. The protrusion is inserted within a longitudinal groove of a dish or cup vertical sliding tube so that the dish is permitted to slide within the dish vertical sliding tube along the longitudinal groove. The dish vertical sliding tube is fixed to a shutter vertical sliding tube within the shutter vertical sliding tube. A dish or cup turning tube is inserted between the dish vertical sliding tube and the shutter vertical sliding tube. The dish turning tube has a spiral guide groove wound along the longitudinal direction of the dish turning tube. The protrusion of the dish is positioned within the spiral guide groove of the dish turning tube. The longitudinal axes of the dish vertical sliding tube, the shutter vertical sliding tube, and the dish turning tube are substantially parallel. An upper case with an opening is fixed to the dish turning tube. A shutter enclosed by the upper case such that when the upper case is turned relative to the shutter turning tube in one direction, the shutter retracts to expose the opening of the upper case while the dish moves toward the opening. When the upper case is turned relative to the shutter turning tube in the opposite direction, the shutter closes the opening and the dish moves away from the opening.

6 Claims, 7 Drawing Sheets

AUTOMATIC LIPSTICK CASE

BACKGROUND OF THE INVENTION

The invention relates to a lipstick case which automatically opens a cover when lipstick is extended from the case and automatically closes the cover when the lipstick is retracted.

FIG. 1 indicates a disassembled view of a previous lipstick case.

In the previous lipstick case, a dish or cup 100, having a machined protrusion 102 on a body 101, functions as a case for housing a lipstick L. A dish or cup vertical sliding tube 200 has a straight guide groove 202 machined in the longitudinal direction of the body 201. The lower portion of the body 201 is so arranged to be a connection portion 203 for attachment to a lower case 400 that is used as, for example, a separately formed handle. A dish or cup turning tube 300 has a spiral guide groove 302 machined along an inner circumferential surface of a body 301. A lower case 400 has a connection portion 402 to be attached to the connection portion 203 of the dish vertical sliding tube 200. The lower case 400 is formed and is used both as a lower portion of the case and as a handle. An upper case 500 is provided for enclosing and covering a lipstick L.

FIG. 2 indicates a sectional view of the previous lipstick case assembly. An outer cylindrical portion of the vertical sliding dish tube 200 is inserted into a dish turning tube 300 so that their mutual turning may be possible. A protrusion 102 of the dish 100 is arranged to be inserted into spiral groove 302 of dish turning tube 300 through straight guide groove 202 of dish vertical sliding tube 200. Thus the dish 100 is housed in dish vertical sliding tube 200. In the bottom region, the connection portion 203 of dish vertical sliding tube 200 is attached to the connection portion 402 of lower case 400. Dish vertical sliding tube 200 and lower case 400 are thus assembled. After the dish 100 houses lipstick L, said elements are to be covered with upper case 500.

When using the lipstick case formed in this way, after pulling upper case 500 off, the lower case 400 is turned by taking the dish turning tube 300 by one hand and the lower case 400 by the other hand at the same time. The dish vertical sliding tube 200 is turned together with the lower case 400, and the protrusion 102 of dish 100 turns along the spiral guide groove 302 of dish turning tube 300 and moves up and down along the straight guide groove 202 of dish vertical sliding tube 200. Thus, the lipstick L, together with dish 100, juts to the outside of dish vertical sliding tube 200 to be ready to use. After using the lipstick L, the lower case 400 is turned in the reverse direction contrary to the above, by taking the dish turning tube 300 by one hand, and by taking the lower case 400 by the other hand. The dish 100 moves down together with lipstick L. In this way, when the lipstick L together with dish 100 has moved down, lipstick L becomes in a safe keeping position by closing and covering the lipstick L with the upper case 500.

However, when using the previous lipstick case as described above, the upper case 500 should be removed. After finishing the application of the lipstick L, lipstick L is to be safely kept by enclosing and covering it with the upper case 500. Therefore, applying make up by holding a mirror by one hand while removing the upper case 500 with the same hand is very inconvenient. Furthermore, whenever the upper case 500 is removed, there is the opportunity for the upper case 500 to be misplaced or lost. Thus, impurities may become stuck to the lipstick L because the lipstick L is unprotected by the upper case 500.

SUMMARY OF THE INVENTION

A lipstick case according to the present invention has a lipstick dish or cup which has a protrusion. The protrusion is inserted within a longitudinal groove of a dish or cup vertical sliding tube so that the dish is permitted to slide within the dish vertical sliding tube along the longitudinal groove. The dish vertical sliding tube is fixed to a shutter vertical sliding tube within the shutter vertical sliding tube. A dish or cup turning tube is inserted between the dish vertical sliding tube and the shutter vertical sliding tube. The dish turning tube has a spiral guide groove wound along the longitudinal direction of the dish turning tube. The protrusion of the dish is positioned within the spiral guide groove of the dish turning tube. The longitudinal axes of the dish vertical sliding tube, the shutter vertical sliding tube, and the dish turning tube are substantially parallel. An upper case with an opening is fixed to the dish turning tube. A shutter enclosed by the upper case such that when the upper case is turned relative to the shutter turning tube in one direction, the shutter retracts to expose the opening of the upper case while the dish moves toward the opening. When the upper case is turned relative to the shutter turning tube in the opposite direction, the shutter closes the opening and the dish moves away from said opening.

FIG. (a) shows a lipstick outlet closed by the shutter.

FIG. (b) shows a lipstick outlet opened by the shutter.

Figure 7:
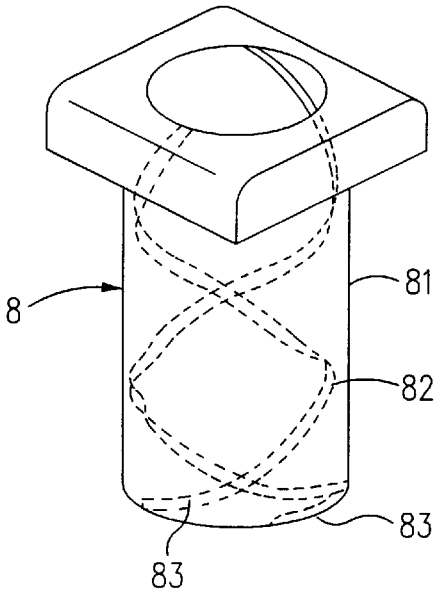

FIG. 7 shows a perspective view of a dish turning tube for the first practical example.

Figure 8:
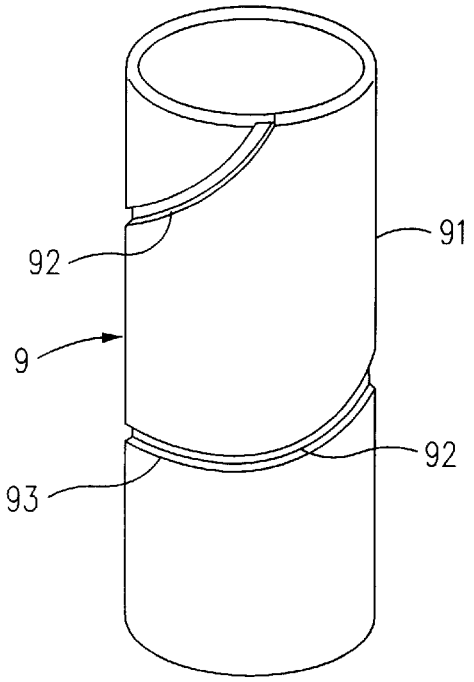

FIG. 8 shows a perspective view of a shutter turning tube for the second practical example.

Figure 9:
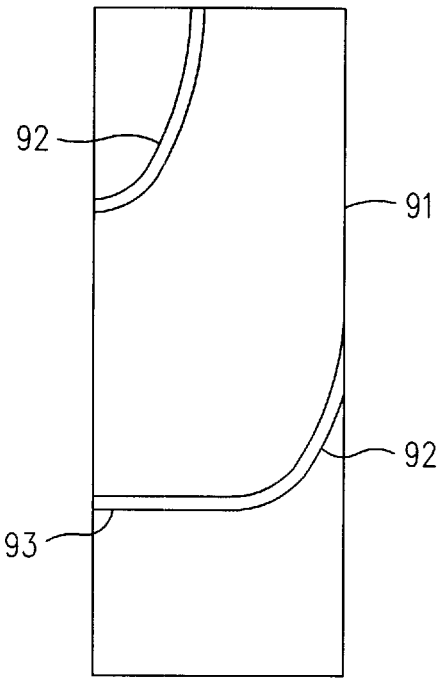

FIG. 9 shows a front view of a shutter turning tube for the third practical example.

DETAILED DESCRIPTION OF THE INVENTION

Figure 1:
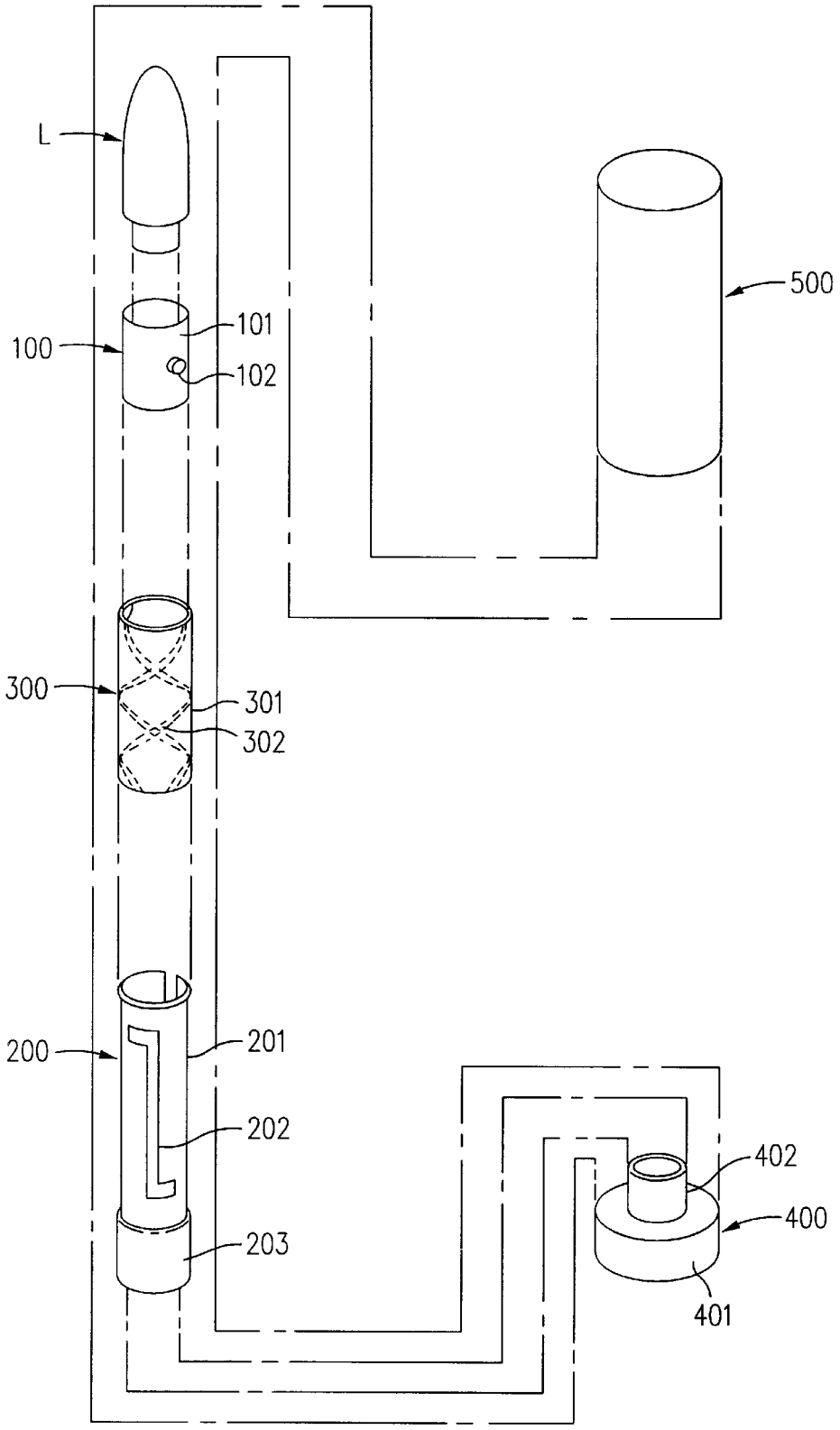
PRIOR ART FIG. 1
FIG. 1 shows a perspective view of a previous disassembled lipstick case.
Figure 2:
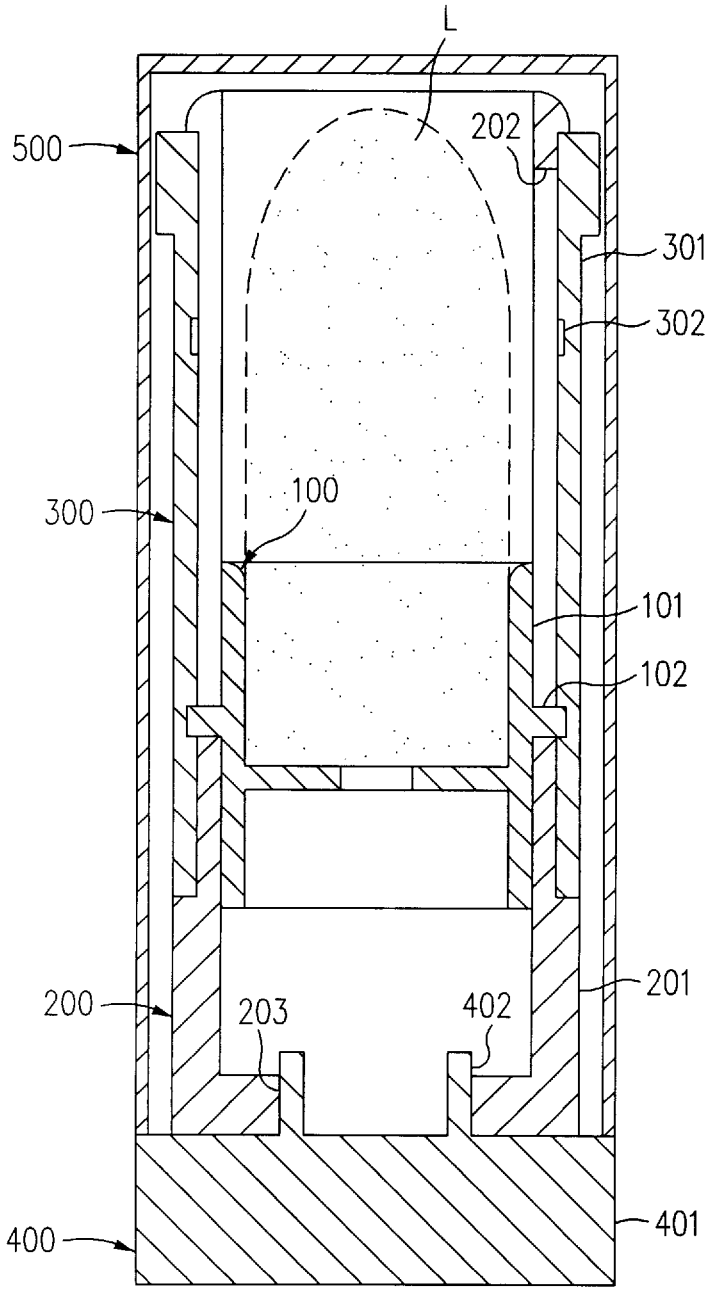
PRIOR ART FIG. 2
FIG. 2 shows a sectional view of a previous lipstick case assembly.
Figure 3:
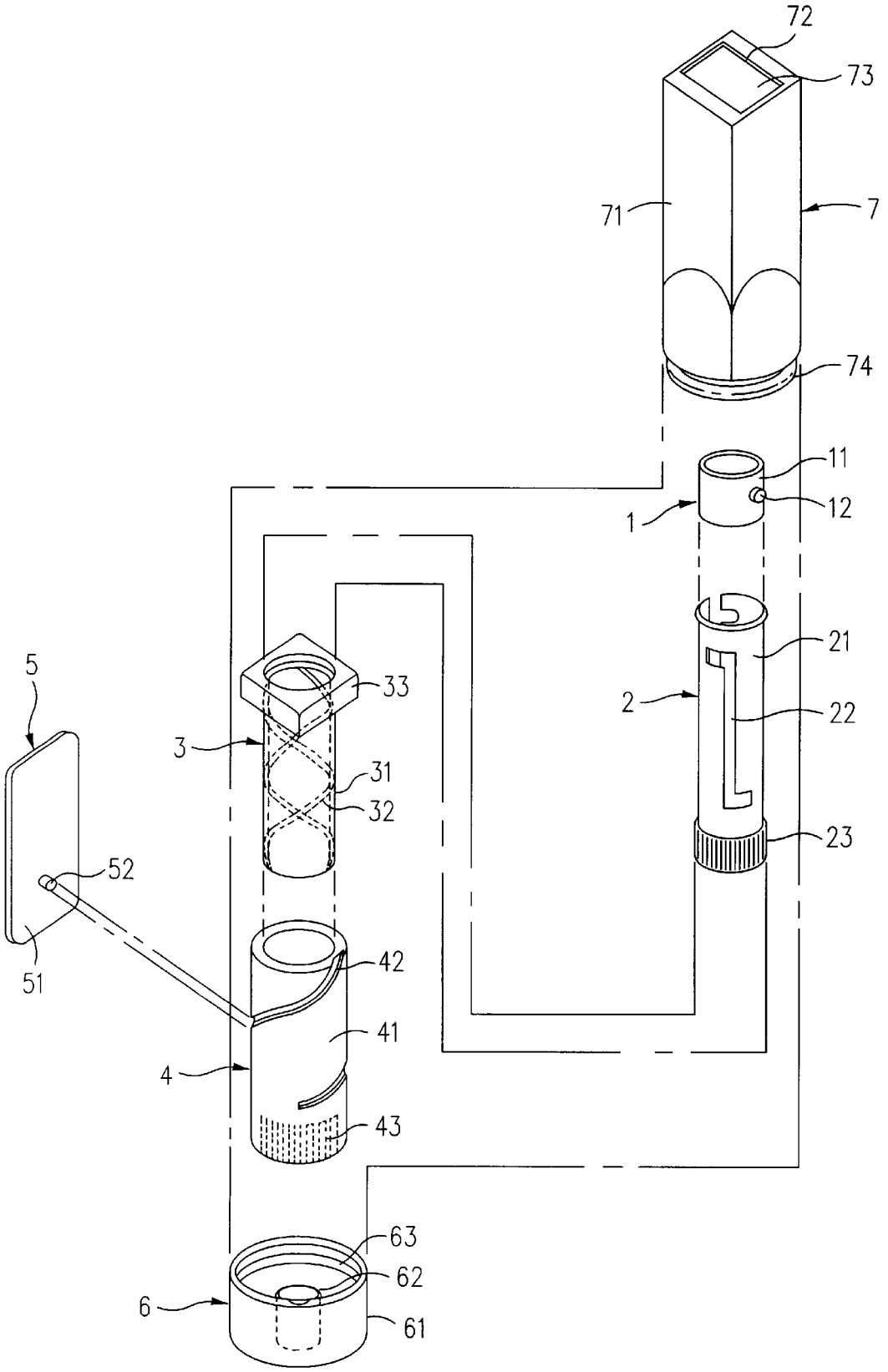
FIG. 3 shows a perspective view of a dissembled automatic lipstick case according to the invention.
Figure 4:
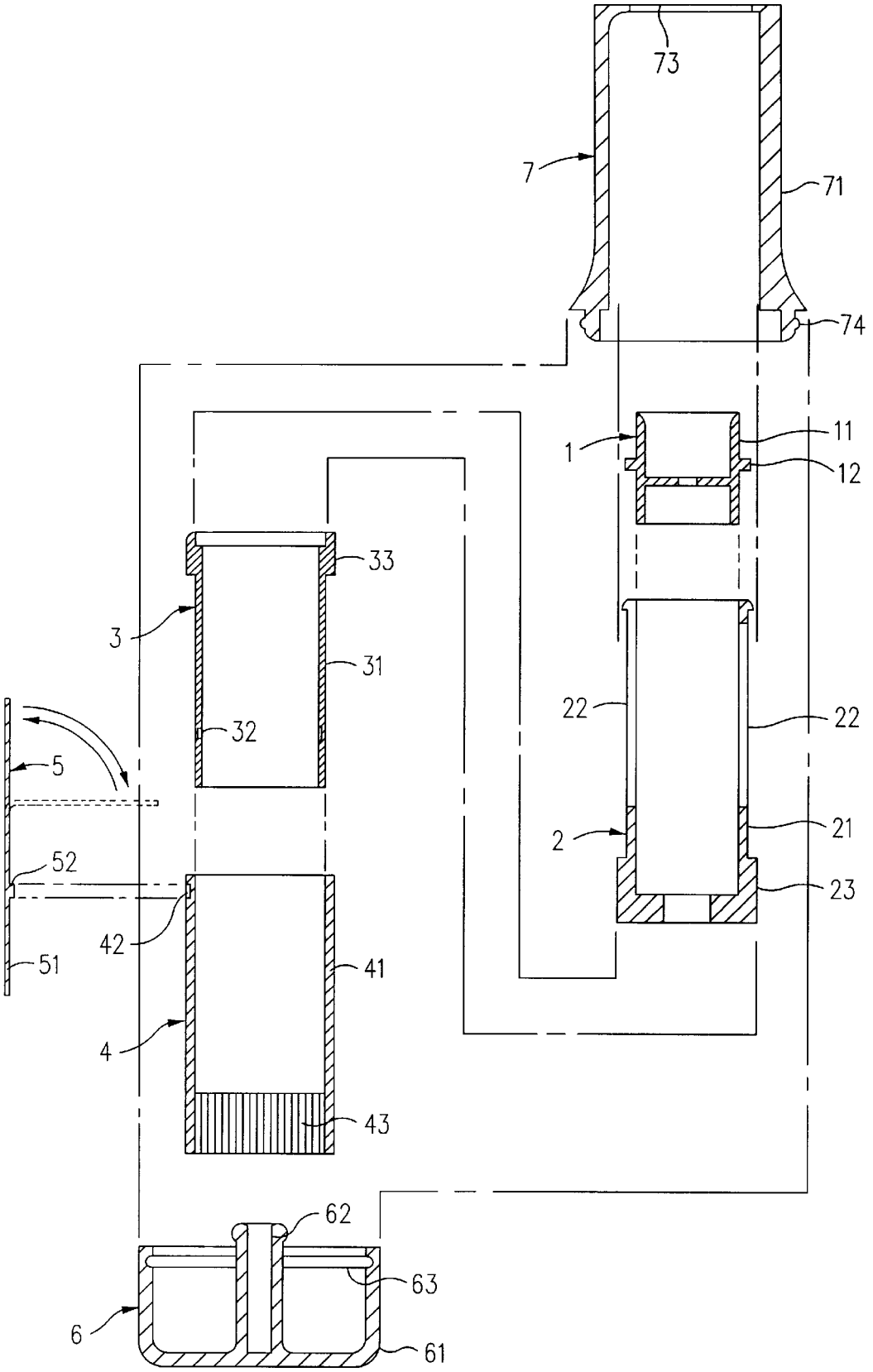
FIG. 4 shows a sectional view of a dissembled automatic lipstick case according to the invention.

FIG. 3 indicates a perspective view of a disassembled automatic lipstick case. FIG. 4 to FIG. 9 indicate sectional views for each element.

The automatic lipstick case according to the invention is provided with a housing (e.g., dish or cup 1) for housing a lipstick L. A dish or cup vertical sliding tube 2, into which the dish 1 is inserted, guides vertical motion of the dish 1. A dish or cup turning tube 3 functions to provide a dish turning motion of said dish 1 and dish vertical sliding tube 2. At the same time, the dish turning tube 3 houses the dish 1 and dish vertical sliding tube 2 together. A shutter vertical sliding tube 4 guides a vertical motion of a shutter 5 so that dish turning motion along an outer surface of said dish turning tube 3 is possible. A shutter assembly moves vertically along the spiral guide groove of said shutter vertical sliding tube 4. A lower case 6 is capable of turning both the dish vertical sliding tube 2 and the shutter vertical sliding tube 4 simultaneously. An upper case assembly capable of turning relative to the lower case 6 houses the dish turning tube 3, in order to guide the movement of the dish turning tube 3.

The dish 1 has a machined guide protrusion 12.

The dish vertical sliding tube 2 has a machined guide groove 22 lengthwise along the body 221. When a protrusion 12 of the dish 1 is inserted into the guide groove 22, the guide groove 22 guides a vertical motion of the dish 1. On the lower portion of the body 21, a connection portion 23 is attached to the shutter vertical sliding tube 4. In FIG. 3, one example of the machined connection portion 23 in a saw teeth or spline profile is shown.

The dish turning tube 3 has a machined guide groove of spiral form 32 along the circumferential inner surface of the body 31, and also on the upper end face of the body 31. A definite profile as a stopper 33 is provided for matching the upper case 7 (one practical example according to the invention shows a rectangular form). Furthermore, when the dish turning tube 3 is inserted into the case 7, the stopper 33 is restricted in its movement due to contact with the guide surface of the case 7. The dish turning tube 3 is always in a position to be either stationary or turning with respect to the upper case 7. The stopper 33 also functions as a guide for the shutter.

The shutter vertical sliding tube 4 has a machined spiral guide groove 42 along the outer circumferential surface, wherein the spiral direction of the spiral guide groove 42 is so arranged that the movement direction of the shutter 5 may be opposite that of the dish 1 when the shutter 5 is inserted into the spiral guide groove 42. On the lower portion of the body 41, a machined connection portion 43 is provided to be attached to the connection portion 23 of the dish vertical sliding tube 2. In this case, the profile of the connection portion 43 in a saw teeth or spline form is provided for matching the connection portion 23 of said dish vertical sliding tube 2.

The shutter 5 is formed of a body 51 of soft material with a guide protrusion 52.

The lower case 6 forms a connection portion 62 for being fixed to one of the connection portions 23 or 43 of the respective vertical sliding tubes 2 or 4. A machined turning guide 63 is provided around the circumferential surface of the body 61 such that when the upper case 7 is inserted into the turning guide 63, the machined turning guide 63 is arranged to guide dish turning motion of said case 7.

The upper case 7 is formed of a body 71 with a definite profile (FIG. 3 shows a rectangular section form as an example) and size capable of housing said shutter 5. On the upper end portion of the body 71, a guide piece 72 is provided with a little less width than that of said shutter 5 to guide said shutter 5. Also on the upper end portion of the body 7, the portion excluding the guide piece 72 is provided with the lipstick L outlet 73 machined such that the lipstick L is capable of extending from and retracting into the outlet 73. On lower end portion of the body 71, a turning portion 74 is formed to fit with the turning guide 63 of the lower case 6.

Figure 5:
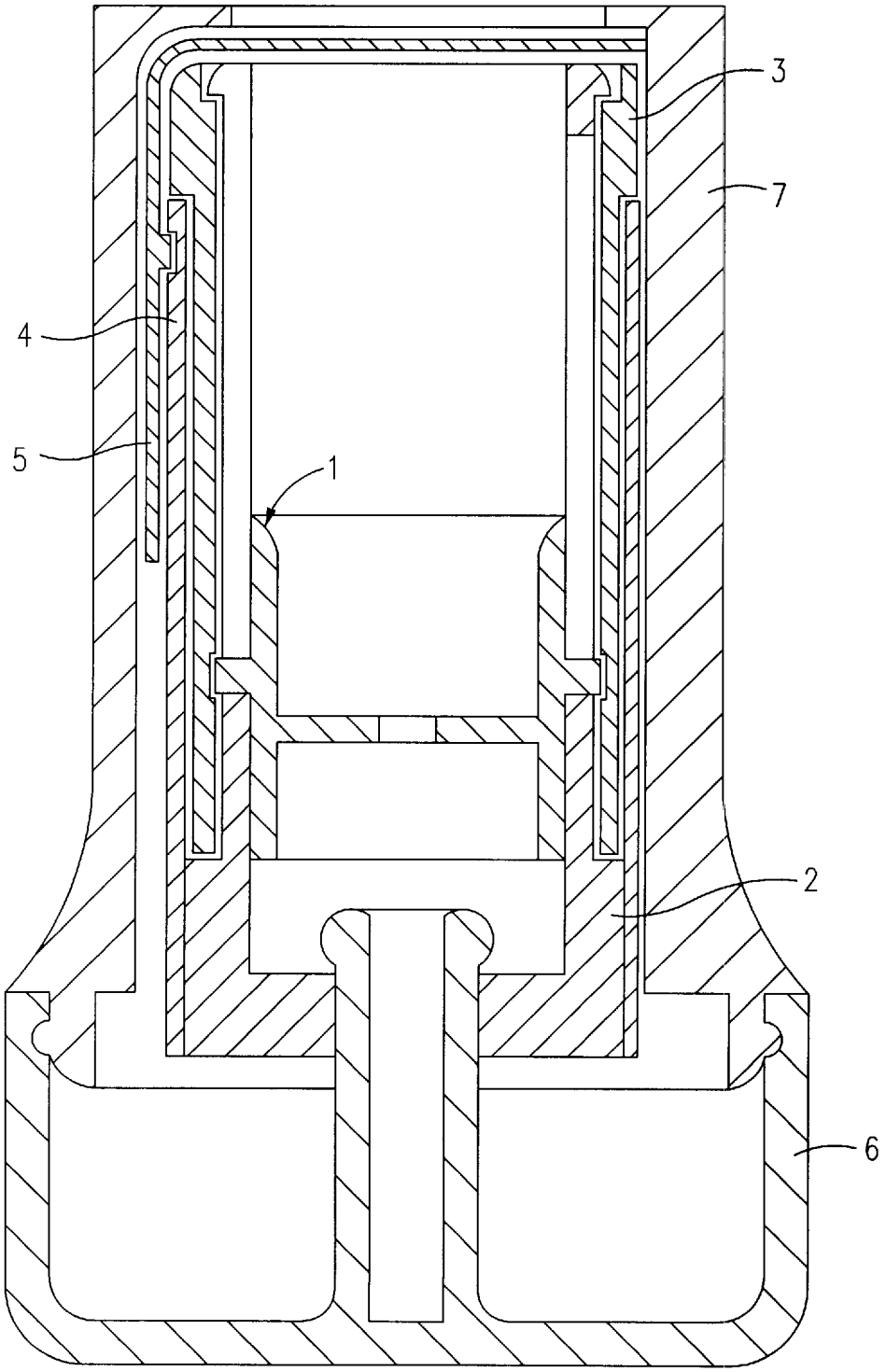
FIG. 5 shows a sectional view of an automatic lipstick case assembly according to the invention.

An assembled state of combining the elements so formed is observed in FIG. 5.

A protrusion 12 of the dish 1 is fitted in the guide groove 22 of the vertical sliding tube 2. The dish 1 is mounted to the dish vertical sliding tube 2. On the other hand, in mounting the dish turning tube 3 to the body 21 of the dish vertical sliding tube 2, the protrusion 12 is to be mounted so that the protrusion 12 extends through said straight guide groove 22 and into the inner spiral guide groove 32 for the dish turning tube 3.

Further, the shutter vertical sliding tube 4 is mounted so that it may turn around the outer circumferential surface of the dish turning tube 3, wherein the connection portion 23 of the dish vertical sliding tube 2 is mounted on the connection portion 43 of the shutter dish turning tube 4. The connection portion 62 of the lower case 6 is assembled to be connected to the connection portion 23 of the vertical sliding tube 2. Thus the dish vertical sliding tube 2 and the shutter vertical sliding tube 4 are mounted so that they may turn together with the lower case 6.

The protrusion 52 of the shutter 5 is inserted into the spiral guide groove 42 of the shutter vertical sliding tube 4. The upper case 7 is assembled by enclosing and covering dish 1, vertical sliding tube 2, dish turning tube 3, shutter vertical sliding tube 4, and shutter 5. The dish turning portion 74 of the upper case 7 is matched with the turning guide 63 for the lower case 6 so that the upper and lower cases 7 and 6 may be mutually turned. The dish 1 houses the lipstick L.

Figure 6B:
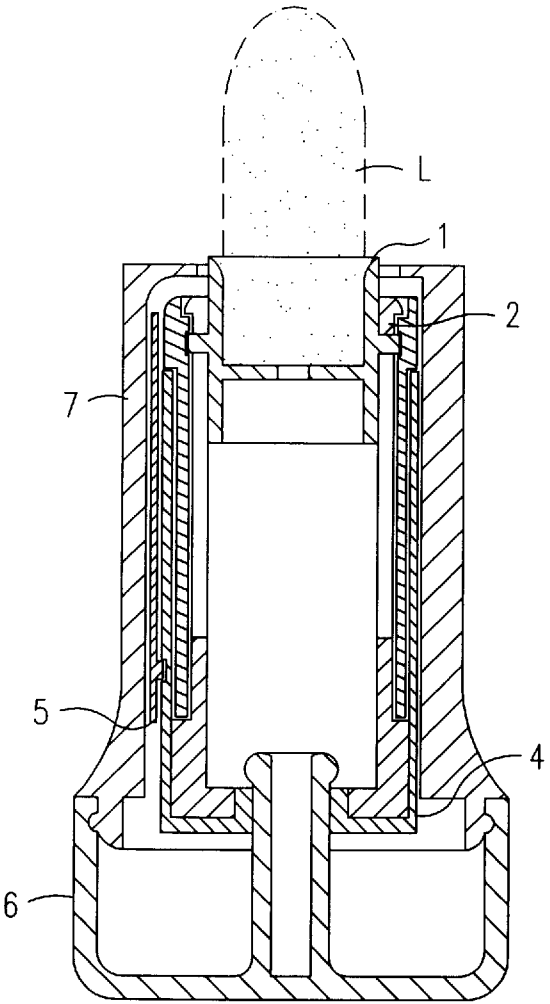
FIG. 6 indicating applied aspect for an automatic lipstick according to the invention.
Figure 6A:
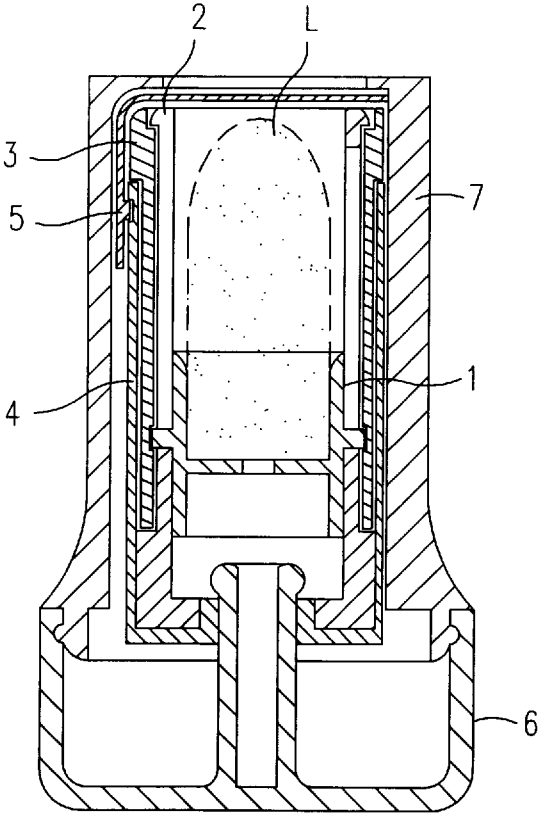

FIG. 6 indicates a practical application for an automatic lipstick case according to the invention.

When using the lipstick L, the upper case 7 is taken by one hand (for example, the right hand) and the lower case 6 is taken by the other hand (for example, the left hand). The lower case 6 is turned to the right. The dish turning tube 3 stands still. On the other hand, the lower case 6 turns both of the dish and shutter vertical sliding tubes 2 and 4 at the same time. Thus, said shutter vertical sliding tube 4 opens the outlet 73 of the upper case 7 by having the shutter 5 move down. Meanwhile, the dish vertical sliding tube 2 lifts the dish 1 up and juts the lipstick L out to the outside of the outlet 73 of the upper case 7 to be ready for use. After using the lipstick L, lipstick L moves down together with the dish 1 in the reverse direction by turning the lower case 6 to the left. Meanwhile, the shutter 5 ascends and closes the outlet 73 of the upper case 7.

In this way, in the automatic lipstick case according to the invention, by turning the lower case with respect to the upper and case, an automatic motion for opening and closing the shutter is achieved. A corresponding up and downward motion of the lipstick L is achieved. Therefore, the present invention provides a very convenient way of using the lipstick without worrying about losing its case.

FIG. 7 to FIG. 9 indicate other practical examples for the automatic lipstick case. Opening motion of the shutter 5 begins at the same time as the lipstick L moves up. As the lipstick L finishes descending motion, at the same time, the shutter 5 begins to close.

To overcome some direct rubbing or interference during each up and downward motion between the shutter and lipstick, one preventive measure is provided. After the shutter is fully opened, the lipstick extends out. Also, only after the lipstick is in its full downward motion, the shutter may be closed. To ensure these motions, a horizontal guide groove 83 is extended at the end point of the spiral guide groove 82 of the dish turning tube 8. An extension 93 similar to extension 83 is provided at the end point of the spiral guide groove 92 of the shutter dish turning tube 9. Thus, when turning the dish vertical sliding tube 2 and the shutter dish turning tube 9 together with the lower case 6 to the right to lift the lipstick L upward, the dish and the lipstick L stand still while protrusion 12 is engaged with the horizontal guide groove 83. The shutter continues to open as the lower case is turned to the right. Just at the fully opening stage of the shutter, the dish 1 begins to jut up along the spiral guide groove 82 of the dish turning tube 8. When turning the dish turning tube 8 and the shutter 9 together with the lower case 6 to the left, the shutter 5 stands still in the horizontal guide groove 93 while the lipstick L moves fully down. Then at this stage, the shutter begins to move upward along the spiral guide groove 92 of the dish turning tube 9 and closes the lipstick L.

What is claimed is:

1. A lipstick case comprising:

a cup for holding lipstick, said cup including a protrusion;

a cup vertical sliding tube comprising a longitudinal groove, said protrusion of said cup inserted within said longitudinal groove such that said cup is slidably movable within said cup vertical sliding tube along said longitudinal groove;

a shutter vertical sliding tube, wherein said shutter vertical sliding tube is fixed to said cup vertical sliding tube, wherein said cup vertical sliding tube is positioned within said shutter vertical sliding tube;

a cup turning tube inserted between said cup vertical sliding tube and said shutter vertical sliding tube, said cup turning tube having a spiral guide groove extending along a longitudinal direction of said cup turning tube, wherein said protrusion of said cup is positioned within said spiral guide groove of said cup turning tube;

an upper case fixed to said cup turning tube; and a shutter enclosed within said upper case such that when said upper case is turned about a longitudinal axis relative to said shutter vertical sliding tube in one direction, said shutter retracts to expose an opening of said upper case and said cup moves toward the opening, wherein when said upper case is turned relative to said shutter vertical sliding tube in the opposite direction, said shutter closes the opening and said cup moves away from the opening.

2. The lipstick case of claim 1, further comprising a lower case fixed to said cup vertical sliding tube and said shutter vertical sliding tube.

3. The lipstick case of claim 2, wherein said shutter vertical sliding tube further comprises a spiral guide groove extending along a longitudinal axis of said shutter vertical sliding tube; and wherein said shutter further includes a protrusion which extends into the spiral guide groove of said shutter vertical sliding tube.

4. The lipstick case of claim 2, wherein said shutter vertical sliding tube has a pressed fit interconnection with said lower case.

5. The lipstick case of claim 1, wherein said shutter vertical sliding tube further comprises a spiral guide groove extending along a longitudinal axis of said shutter vertical sliding tube; and wherein said shutter further includes a protrusion which extends into the spiral guide groove of said shutter vertical sliding tube.

6. The lipstick case of claim 5, wherein said spiral guide grooves of said shutter vertical sliding tube and said cup turning tube extend in opposite directions.

* * * * *